US007727343B2

(12) United States Patent
Torizuka et al.

(10) Patent No.: US 7,727,343 B2
(45) Date of Patent: Jun. 1, 2010

(54) CONTROLLED WARM-ROLLING METHOD

(75) Inventors: Shiro Torizuka, Tsukuba (JP); Kotobu Nagai, Tsukuba (JP)

(73) Assignee: National Institute for Materials Science, Tsukuba-shi (JP)

( * ) Notice: Subject to any disclaimer, the term of this patent is extended or adjusted under 35 U.S.C. 154(b) by 670 days.

(21) Appl. No.: 10/541,539

(22) PCT Filed: May 20, 2004

(86) PCT No.: PCT/JP2004/007278

§ 371 (c)(1),
(2), (4) Date: Sep. 16, 2005

(87) PCT Pub. No.: WO2004/104236

PCT Pub. Date: Dec. 2, 2004

(65) Prior Publication Data

US 2006/0054255 A1 Mar. 16, 2006

(30) Foreign Application Priority Data

May 20, 2003 (JP) ..... 2003-180292

(51) Int. Cl.
*C21D 8/00* (2006.01)

(52) U.S. Cl. ..... 148/648

(58) Field of Classification Search ..... 148/653, 148/654, 648, 500, 503, 504, 508, 511, 320–337
See application file for complete search history.

(56) References Cited

FOREIGN PATENT DOCUMENTS

| | | |
|---|---|---|
| JP | 2000-309823 | 11/2000 |
| JP | 2000-309850 | 11/2000 |
| JP | 2002-137002 | 5/2002 |
| JP | 2002-192201 | 7/2002 |
| JP | 2003-253332 | 9/2003 |

OTHER PUBLICATIONS

Fujioka et al, JP 09-279233 Machine Translation, Preparing high tensile strength steel having improved toughness by hot rolling at defined temperature ranges and with specified strain rate, Oct. 28, 1997.*

Sakata et al., JP 2001-214214 English Abstract, Working and Hardening Method of Deformed Spring Steel Wire, Aug. 7, 2001.*

Saito, JP 60-200915 English Abstract, Steel strip rolling and cooling by controlling on basis of ferrite structure strains and austenite grain size, Oct. 11, 1985.*

* cited by examiner

*Primary Examiner*—Roy King
*Assistant Examiner*—Jie Yang
(74) *Attorney, Agent, or Firm*—Wenderoth, Lind & Ponack, L.L.P.

(57) ABSTRACT

The invention presents a new warm control rolling method, in consideration of processing heat generation, as a method of stably manufacturing ultrafine crystal steel of 3 microns to 1 micron or less, without any limitation in pass interval or strain speed, being a rolling method of manufacturing steel mainly composed of fine ferrite particle texture with average ferrite grain size of 3 μm or less, in which, in the rolling process of one pass or more wherein the rolling temperature range is a temperature region of 350° C. to 800° C., the material temperature upon start of rolling of each rolling process does not exceed the maximum temperature of 800° C., and the material temperature during rolling and right after final rolling (within 1 second) is not lower than 350° C., temperature $T_{x\text{-}out}$ right after rolling in each rolling process (within 1 second) is not higher than the temperature that is higher than rolling entry temperature $T_{x\text{-}in}$ by 100° C. and the material temperature right after rolling (within 1 second) is not lower than the temperature that is lower than the temperature right before rolling by 100° C.

20 Claims, 7 Drawing Sheets

| | | a(mm) | b(mm) | c(mm) | θ (deg) | R(mm) |
|---|---|---|---|---|---|---|
| #1 | diamond | 103 | 123 | 79 | 100 | 18 |
| #2 | diamond | 92 | 109 | 70 | 100 | 17 |
| #3 | diamond | 81 | 97 | 62 | 100 | 16 |
| #4 | diamond | 73 | 86 | 56 | 99 | 14 |
| #5 | diamond | 65 | 76 | 50 | 99 | 12 |
| #6 | diamond | 59 | 68 | 45 | 99 | 11 |
| #7 | diamond | 54 | 62 | 41 | 98 | 11 |
| #8 | diamond | 54 | 62 | 41 | 98 | 9.5 |
| #9 | diamond | 50 | 56 | 37 | 97 | 8 |
| #10 | diamond | 46 | 51 | 34 | 97 | 7 |
| #11 | diamond | 42 | 47 | 31 | 96 | 6 |
| #12 | diamond | 39 | 44 | 29 | 96 | 5.5 |
| #13 | diamond | 38 | 40 | 28 | 94 | 5.5 |
| #14 | diamond | 34 | 36 | 24 | 94 | 5.5 |
| #15 | oval | 11 | 52 | – | – | 64 |
| #16 | square | 24 | 24 | 17 | 90 | 2.5 |

CONTROLLED WARM-ROLLING METHOD

TECHNICAL FIELD

The present invention relates to a warm control rolling method. More specifically, the invention relates to a manufacturing method of ultrafine particle steel material excellent in strength and ductility having ultrafine crystal structure of grain size of 3 μm or less.

BACKGROUND ART

Ultrafine particle steel can extremely enhance the strength without adding alloy elements, and simultaneously reduces the ductility and brittleness transition temperature extremely, and hence the present inventors have been studying about measures for realizing this ultrafine particle steel industrially, and have already disclosed inventions, warm multipass rolling method (document 1) and multidirectional processing method (document 2).

On the other hand, various methods have been proposed so far for manufacturing ultrafine particle steel, but nothing has been known about the method of controlling the grain size quantitatively.

For example, Fujioka et al. (document 3) proposed a manufacturing method of high tension steel characterized in using a billet comprising C, 0.03 to 0.45 weight (wt.) %, Si: 0.01 to 0.50%, Mn: 0.02 to 5.0%, Al: 0.001 to 0.1%, and balance of Fe and inevitable impurities, processing it by one pass or two or more consecutive passes with interval of each pass of within 20 seconds, at temperature of 500 to 700° C., strain speed of 0.1 to 20/sec, and total strain amount of 0.8 to 5.0, and then cooling slowly.

They also proposed a manufacturing method of high tension steel of fine crystal particles characterized in using a billet comprising, by wt. %, C, 0.03 to 0.9, Si: 0.01 to 1.0, Mn: 0.01 to 5.0, Al: 0.001 to 0.5, N, 0.001 to 0.1, and also at least one of Nb: 0.003 to 0.5 and Ti: 0.003 to 0.5, and balance of Fe and inevitable impurities, and satisfying the relation of C+(12/14)N≧(12+48)Ti(12/487)Nb+0.03, casting it or heating it and cooling it once into the temperature range of 500° C. to room temperature after rolling or without rolling, heating, rolling in warm process at 700 to 550° C. by processing it in one pass or two or more consecutive passes with pass interval of within 10 seconds with draft per pass of 20% or more, at strain speed of 1 to 200 sec, and total strain amount of 0.8 to 5, and then cooling slowly (document 4).

In these two methods, however, nothing is taught about control method of grain size. In these methods, moreover, the pass duration is limited and the strain speed is also limited, and it is considered difficult to apply industrially.

In this background, the inventors have further promoted studies, and found that it is important to control the cumulative strain in multipass rolling, processing temperature, strain speed, and pass duration comprehensively, not individually, in order to form an ultrafine crystal structure. As a result, it is known that the grain size depends on parameter Z of processing temperature and strain speed expressed in formula (1); and the present inventors have proposed a new control method of grain size by clarifying the relation of Z and grain size through one-pass rolling experiment (prior application 1).

$$Z = \log\left[\frac{\varepsilon}{t}\exp\left(\frac{Q}{8.31(T+273)}\right)\right] \quad (1)$$

ϵ: strain t: duration from start till end of rolling (s)

T: rolling temperature (° C., or average of rolling temperature of each pass in the case of multipass rolling)

Q: 254,000 if mother phase of texture just before rolling is ferrite, bainite, martensite, or pearlite; 300,000 if mother phase is austenite.

In this method, to manufacture ultrafine ferrite steel with crystal size of 1 microns or less, it is found that the rolling condition parameter Z in formula (1) should be 11 or more (in the case the texture before rolling is ferrite, bainite, martensite, pearlite or the like, that is, the iron crystal structure is bcc), and that the strain speed can be defined by the value of the total strain ϵ being divided by the time t from start till end of rolling, and hence ultrafine crystal particles of 1 micron or less can be obtained in the condition of strain e=3.0 and total rolling time t=300 s, that is, strain speed=0.01/s, and this newly proposed method can be applied in a wide range.

According to this method, the grain size can be controlled without limitation in pass interval or strain speed.

However, in the subsequent process of researches by the present inventors, new problems have been also unveiled, that is, the actual rolling is continuous multipass process, and when the parameter Z is 11 or more, the rolling temperature corresponds to the warm processing temperature region (350 to 800° C.), and the deformation resistance of steel is large and the processing heat generation of material is large in this case, and the material temperature may rise several hundred degrees during continuous rolling, there by resulting in Z<11, and ultrafine structure of 1 micron may not be formed.

It has been hence demanded to develop a method capable of controlling the grain size stably even in such continuous multipass rolling.

Document 1: Japanese Patent Application Laid-Open No. 2000-309850

Document 2: Japanese Patent Application Laid-Open No. 2001-240912

Document 3: Japanese Patent Application Laid-Open No. 9-279233

Document 4: Japanese Patent Application Laid-Open No. 2000-104115

Prior application 1: Japanese Patent Application No. 2002-54670

The present invention is applied in the light of the above background, and presents a new control rolling method in consideration of processing heat generation, as a method capable of applying the new method of controlling the parameter Z according to the proposal of the inventors in continuous rolling process, stably manufacturing ultrafine crystal steel of 3 microns to 1 micron or less without any limitation in pass internal or strain speed.

DISCLOSURE OF INVENTION

To solve the problems, it is a first aspect of the invention to present a rolling method of manufacturing steel mainly composed of fine ferrite particle texture with average ferrite grain size of 3 μm or less, which comprises, in the rolling process of one pass or more of rolling in condition where the rolling condition parameter expressed in formula (1)

$$Z = \log\left[\frac{\varepsilon}{t}\exp\left(\frac{Q}{8.31(T+273)}\right)\right] \quad (1)$$

ϵ: strain t: duration from start till end of rolling (s)

T: rolling temperature (° C., or average of rolling temperature of each pass in the case of multipass rolling)

Q: 254,000 if mother phase of texture just before rolling is ferrite, bainite, martensite, or pearlite; 300,000 if mother phase is austenite.

is 11 or more (in the case the texture just before rolling is ferrite, bainite, martensite, or pearlite, that is, Fe crystal structure is bcc) or 20 or more (in the case the texture just before rolling is austenite, that is, Fe crystal structure is fcc), and the rolling temperature range is a temperature zone of 350° C. to 800° C., rolling under condition that the material temperature upon start of rolling of each rolling process does not exceed the maximum temperature of 800° C. and the material temperature during rolling and right after final rolling (within 1 second) is not 350° C. or lower, and rolling so that, in each rolling process, temperature $T_{x\text{-}out}$ right after rolling (within 1 second) is not higher than temperature that is higher than rolling entry temperature $T_{x\text{-}in}$ by 100° C. and the material temperature right after rolling (within 1 second) is not lower than temperature that is lower than the temperature right before rolling by 100° C.

Herein, the strain used in formula (1) is an industrially simple strain, that is, true strain e. For example, supposing the initial area of steel bar to be $S_0$ and the C-section area after rolling to be S, the reduction of area R is expressed as $$R=(S_0-S)/S_0 \quad (2)$$

Hence, the true strain e is $$e=-\mathrm{Ln}(1-R)$$

Instead of the true strain, plastic strain obtained by finite element method may be used. Calculation of plastic strain is specifically explained in reference documents (Inoue, et al., "Iron and Steel", 86 (2000) 793; Keizaburo Harumi, et al., "Introduction to finite element method" (Kyoritsu Publishing), Mar. 15, 1990).

The rolling time t may be the total rolling time including the pass intervals.

It is a second aspect to present the warm control rolling method, being characterized in rolling so that the temperature $T_{x\text{-}out}$ right after rolling in each rolling process is not higher than the temperature that is higher than the rolling entry temperature $T_{x\text{-}in}$ by 50° C.

It is a third aspect of the invention to present the warm control rolling method, being characterized in rolling two or more passes consecutively in rolling temperature range of 350° C. to 800° C., in which the material temperature right after two passes is not higher than the temperature that is higher than the material temperature upon start of rolling by 100° C., and not lower than the temperature that is lower than the material temperature upon start of rolling by 100° C., and it is a fourth aspect to present the warm control rolling method, being characterized in rolling so that the material temperature right after two passes is not higher than the temperature that is higher than the material temperature upon start of rolling by 50° C.

It is a fifth aspect of the invention to present the warm control rolling method, being characterized in rolling in rolling temperature range of 400° C. to 500° C., it is a sixth aspect to present the warm control rolling method, being characterized in manufacturing steel with Z≧12 or more and mainly composed of texture with average ferrite grain size of 1 μm or less, it is a seventh aspect to present the warm control rolling method, being characterized in starting rolling, in consecutive multipass rolling, by waiting until the rolling entry temperature $T_{x+1\text{-}in}$ of X+1-th pass becomes $T_S+20 \geqq T_{x+1\text{-}in}$ when the rolling temperature $T_{x\text{-}out}$ right after X-th pass is higher than the rolling set temperature $T_S$, and it is an eighth aspect to present the warm control rolling method, being characterized in measuring the processing heat generation $T_{xH}$ at X-th pass in multipass rolling beforehand, and defining the rolling entry temperature $T_{x\text{-}in}$ in the relation of $T_{xs} \geqq T_{x\text{-}in} \geqq T_{xS}-T_{xH}$, supposing $T_{xS}$ to be rolling set temperature.

It is a ninth aspect of the invention to present the warm control rolling method, being characterized in defining the total reduction area at 50% or more in continuous rolling, it is a tenth aspect to present the warm control rolling method, being characterized in defining the plastic strain, or the strain converted into true strain from the reduction of area at 1.5 or more, it is an eleventh aspect to present the warm control rolling method, being characterized in introducing the strain by multidirectional processing, it is a twelfth aspect to present the warm control rolling method, being characterized in controlling the temperature range before and after rolling by setting the rolling speed and the draft of each pass, and it is a thirteenth aspect to present the warm control rolling method, being characterized in a step of reheating in the midst of rolling for compensating for temperature drop of material, and a step of cooling in the midst of rolling for suppressing temperature rise of material in the continuous rolling.

In the invention of the present application, having such configuration, the new method of controlling by the parameter Z relating to the proposals of the inventors can be applied in the continuous rolling process, and a new control rolling method in consideration of processing heat generation can be realized as a method of stably manufacturing superfine crystal steel of 3 microns to 1 micron or less without any limitation in the pass interval or strain speed.

BEST MODE FOR CARRYING OUT THE INVENTION

The invention has many features as discussed above, and its embodiments are specifically described below.

In the method of the invention, in order to manufacture fine ferrite particle structure with average ferrite grain size of 3 μm or less as main constituent, that is, to manufacture steel having ultrafine texture of average ferrite grain size of 3 μm or less in 60% or more range of surface area of its section, in principle, the rolling is executed in the following condition:

<A> In a range of rolling condition parameter Z expressed in formula (1) is 11 or more (in the case the texture before rolling is ferrite, bainite, martensite, pearlite or the like, that is, iron crystal structure is bcc) or 20 or more (in the case the texture before rolling is austenite, that is, iron crystal structure is fcc), and <B> In the rolling process of one pass or more with rolling temperature range of a temperature region of 350° C. to 800° C., the material temperature upon start of rolling of each rolling process does not exceed the maximum temperature of 800° C., and the material temperature during rolling and right after final rolling (within 1 second) is not lower than 350° C., and then temperature $T_{x\text{-}out}$ right after rolling in each rolling process (within 1 second) is not higher than the temperature that is higher than rolling entry temperature $T_{x\text{-}in}$ by 100° C., and the material temperature right after rolling is not lower than a temperature that is lower than the temperature right before rolling by 100° C.

Figure 1:
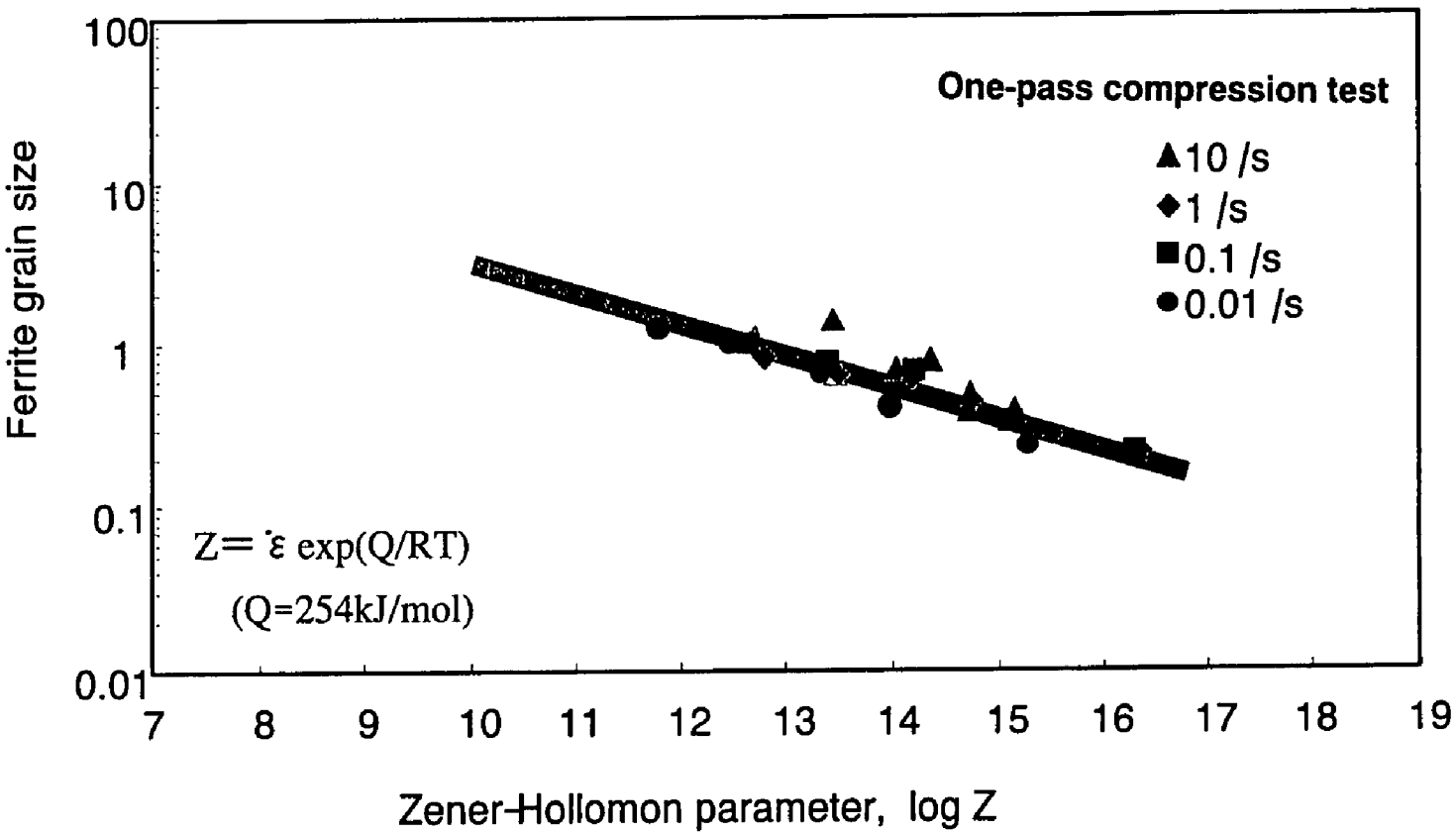
FIG. 1 is a diagram showing the relation of parameter Z and ferrite average grain size relating to formula (1).

According to the studies by the inventors, the parameter Z in formula (1) is known to be an easy index for obtaining ultrafine crystal structure of average grain size, and has been already proposed in the application of Japanese Patent Application No. 2002-54670. The inventors have studied and clarified that the average grain size of ultrafine crystals formed by warm processing depends on the processing temperature and strain speed, and that the crystal grain size becomes smaller along with increase of rolling condition parameter Z which is a function of processing temperature and strain speed. To obtain texture of average grain size of 1 μm or less, the rolling condition parameter must be set higher than a certain critical value. As a result of experiment by one-pass large strain compression process using small sample pieces, the critical value is confirmed to be about 11 in the case of bcc structure iron (ferrite, bainite, martensite, pearlite or the like), and about 20 in fcc structure iron (austenite) (FIG. 1).

Herein, the strain used in formula (1) may be an industrially simple strain, that is, true strain e. For example, supposing the initial area of steel bar to be $S_0$ and the C-section area after rolling to be S, the reduction of area R is expressed as $$R=(S_0-S)/S_0 \tag{2}$$

Hence, the true strain e is $$e=-\mathrm{Ln}(1-R)$$

Instead of the true strain, plastic strain obtained by finite element method may be used. Calculation of plastic strain is specifically explained in reference documents (Inoue, et al., "Iron and Steel", 86 (2000) 793; Keizaburo Harumi, et al., "Introduction to finite element method" (Kyoritsu Publishing), Mar. 15, 1990).

More specifically, the plastic strain can be calculated according to the flow shown in Table 1.

TABLE 1

| Calculation flow of plastic strain |
|---|
| 1. Acquire stress-strain curve corresponding to the processing temperature of material. |
| 2. Prepare for finite element method calculation. |
| (1) Form mesh on the workpiece. |
| (2) Determine contact condition; coefficient of friction = 0.3 coulomb condition. |
| (3) Determine stress-strain curve and material physical properties. |

TABLE 1-continued

| Calculation flow of plastic strain |
|---|
| 3. In the conditions of (1) to (3), calculate by the all-purpose finite element method code, for example, ABAQUS. Plastic strain ε is expressed in the following formula, and each strain increment is calculated by the all-purpose finite element method code. |
| $\varepsilon=\frac{2}{3}\sqrt{\left[\frac{1}{2}\{(d\varepsilon_x-d\varepsilon_y)^2+(d\varepsilon_y-d\varepsilon_z)+(d\varepsilon_z-d\varepsilon_x)^2\}+\frac{3}{4}(d\gamma_{xy}^2+d\gamma_{yz}^2+d\gamma_{zx}^2)\right]}$ |
| $d\varepsilon_x$, $d\varepsilon_y$, $d\varepsilon_z$: strain increment of x, y, z |
| $d\gamma_{xy}$, $d\gamma_{yz}$, $d\gamma_{zx}$: strain increment of x, y, z |

In the warm control rolling method of the invention, accordingly, the rolling condition is set so that the parameter Z may be 11 or more (bcc structure) or 20 or more (fcc structure) as specified in <A>.

More important, the temperature is controlled characteristically as in <B> in the warm control rolling method of the invention.

Microscopic local azimuth differences caused by machining large strains by warm processing become sources of ultrafine crystals, and in the recovery process taking place during processing or after processing, dislocation density in particle declines, and crystal grain boundary is formed at the same time and ultrafine texture is composed. If the temperature is low, recovery is insufficient, and processed texture of high dislocation density is left over. If the temperature is too high, discontinuous recrystals or crystal grains by ordinary particle growth become coarse, and ultrafine particle texture of 3 μm or less is not obtained. In the invention, therefore, the rolling temperature is limited in a range of 350° C. to 800° C.

Rolling is executed by controlling as follows: temperature $T_{x\text{-}out}$ right after rolling (within 1 second) in each rolling is not higher than 100° C. than rolling entry temperature $T_{x\text{-}in}$, and the material temperature right after rolling is not lower than 100° C. than the temperature before rolling.

This temperature control is also essential for the invention. Without such control, actually, if the parameter Z is within the specified range, it is difficult to control within the specified crystal grain size at grain size of 3 μm or less.

$T_{x\text{-}out}$ is not higher than a temperature that is higher than $T_{x\text{-}in}$ by 100° C., and more preferably by 50° C. In consecutive rolling of two or more passes, preferably, the material temperature right after two passes should not be higher than a temperature that is higher than the material temperature upon start of rolling by 100° C., more preferably by 50° C., and should not be lower than a temperature that is lower than the material temperature upon start of rolling by 100° C.

To obtain texture of ultrafine particles with average ferrite grain size of 1 μm or less, preferably, the parameter Z should be 12 or more as for <A>, and the temperature range should be 400 to 500° C. as for <B>.

In the invention, as described above, in consecutive multi-pass rolling, if the rolling temperature $T_{x\text{-}out}$ right after x-th pass is higher than the rolling set temperature Ts, rolling should be preferably started after waiting until the rolling entry temperature $T_{x+1\text{-}in}$ of x+1-th pass becomes $T_s+20 \geqq T_{x+1\text{-}in}$, or by preliminarily measuring the processing heat generation $T_{xH}$ at x-th pass, it may be desired to set rolling entry temperature $T_{xs} \geqq T_{x\text{-}in} \geqq T_{xs}-T_{xH}$ supposing $T_{xs}$ to be the rolling set temperature.

The temperature control may have temperature changes as mentioned above, or in continuous rolling, it may be designed to reheat in the midst of rolling to compensate for material temperature drop, or to cool by force in the mist of rolling for suppressing the temperature rise of the material.

In the invention, the temperature refers to the material surface temperature.

In the invention, the total cumulative reduction strain increases along with increase of strain due to formation of fine crystal particles from the processing particles flattened by warm process, and in order to obtain a structure almost completely composed of superfine crystals, at least strain of 1.5 is needed, or more preferably strain of 2 or more.

In this case, the strain is a plastic strain, or reduction of area converted to true strain, and averages for rolling may include various rolls, and in the case of bar steel, it may be rolled by groove roll.

In the invention, mechanism for enhancing the strength by phase transformation is not used, and addition of alloy element is not needed for enhancing the strength, and the steel composition is not limited, and various steel types free from phase transformation such as ferrite single phase steel and austenite single phase steel, and steel materials of wide composition range can be used. A more specific example of composition comprises, by wt. %, C, 0.001% or more to 1.2% or less, Si: 0.1% or more to 2% or less, Mn: 0.1% or more to 3% or less, P: 0.2% or less, S: 0.2% or less, Al: 1.0% or less, N, 0.02% or less, Cr, Mo, Cr, Ni: 30% or less in total, Nb, Ti, V: 0.5% or less in total, B: 0.01% or less, and balance of Fe and inevitable impurities, not containing any alloy element. Alloy elements such as Cr, Mo, Cu, Ni, Nb, Ti, V, B may be added more than the specified range as required, or may not be contained at all.

Embodiments are shown below and described further. It must be noted, however, that the invention is not limited to these examples alone.

EMBODIMENTS

Table 2 shows the composition (balance Fe) of steel materials in the following examples.

In these examples, cooling is air cooling.

TABLE 2

| | (mass %) | | | | | | |
|---|---|---|---|---|---|---|---|
| Type of steel | C | Si | Mn | P | S | N | s.Al |
| a | 0.15 | 0.3 | 1.5 | 0.01 | 0.001 | 0.001 | 0.03 |
| b | 0.10 | 0.3 | 1.5 | 0.01 | 0.001 | 0.001 | 0.03 |
| c | 0.05 | 0.3 | 1.5 | 0.01 | 0.001 | 0.001 | 0.03 |

In Tables 3 to 6 below, the blank right column of pass No. refers to so-called "common passing," that is, the same caliber is passed twice, and hence the reduction of area is indicated at the second pass.

The parameter Z is calculated in the final pass because it must be calculated after application of a specific strain. The symbols are as follows: t=total time, T=exit average temperature, $\epsilon$=total strain.

Embodiment 1

A steel material of 80×80×600 mm having the composition shown in Table 2a was heated to 500° C., rolled in caliber at rolling set temperature T1 (499° C.), and rolled in 21 passes at reduction of area of 91% (true strain 2.4) until the section was reduced to 24×24 mm. Supposing the total rolling time of 600 s, the set value of Z was 15.0. From FIG. 1, the ferrite grain size is estimated to be 0.4 micron.

Figure 2:
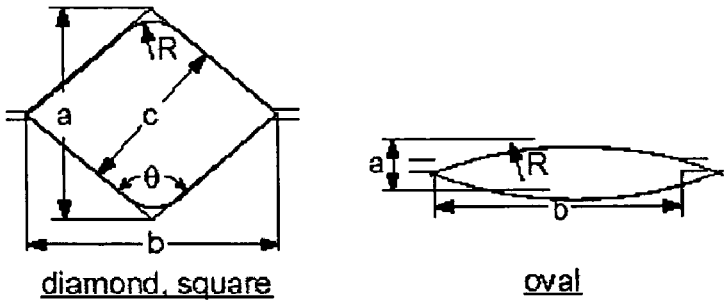
FIG. 2 is front view and dimensional drawing showing caliber shape of groove roll of each pass.

Caliber shape of each pass is shown in FIG. 2, and the draft and temperature changes before and after are given in Table 3. Right after rolling of even-number pass, the temperature (exit temperature) $T_{x\text{-}out}$ was measured, and when the exit temperature was lower than 500° C., rolling of next pass was started immediately, but when exceeding 500° C., rolling of next pass (odd-number pass) was started after waiting until the material temperature dropped below 499° C. As a result, the rolling was carried out in a range of entry temperature $T_{x\text{-}in}$ of 455 to 499° C. (average 495° C.) and exit temperature $T_{x\text{-}out}$ of 472 to 543° C. (average 520° C.). Therefore, although the maximum processing heat generation in rolling of two consecutive passes was 40° C., by setting the rolling waiting time, the rolling setting temperature of 499° C. did not exceed 550° C. throughout the whole rolling process. In other words, processing heat generation occurred in each pass, but did not exceed the set temperature by more than 50° C. By the total rolling time of 895 s and average exit temperature, the value of Z was calculated again, and Z=14.2 was obtained. The calculated ferrite grain size was 0.45 micron.

Figure 3:
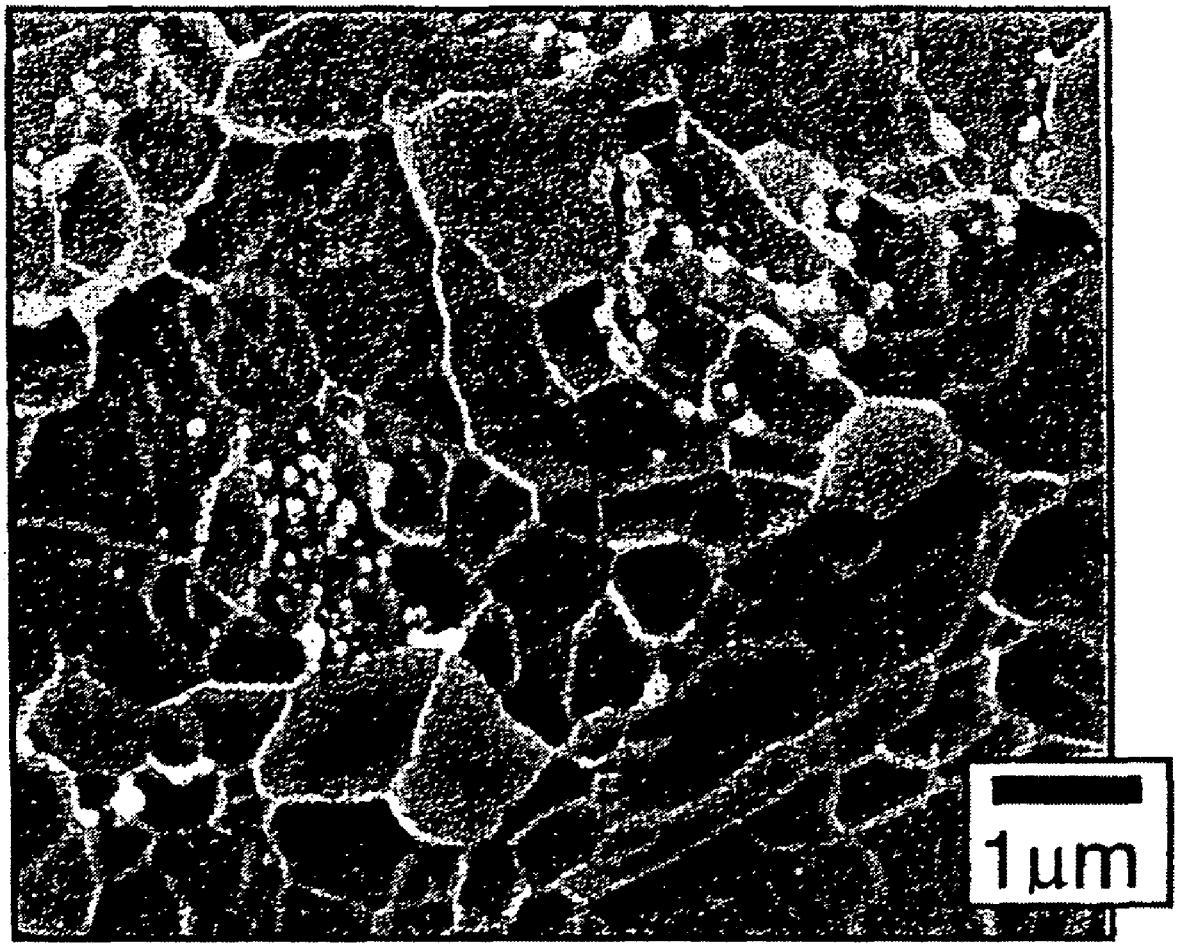
FIG. 3 is a texture SEM image in embodiment 1.

In the obtained bar steel, the C section microscopic image is shown in FIG. 3. The composition is ultrafine equiaxial ferrite+cementite texture. The average ferrite grain size was 0.6 micron. Its mechanical properties are shown in Table 7, and a steel bar of excellent tensile strength of 788 MPa was obtained.

TABLE 3

| Pass No. | Reduction of area (%) | Total reduction of area (%) | Total strain (—) | Pass interval (s) | Rolling wait | Entry temperature $T_{x\text{-}in}$ (° C.) | Exit temperature $T_{x\text{-}out}$ (° C.) | Caliber | Z value |
|---|---|---|---|---|---|---|---|---|---|
| 1 | | | | 0 | | 455 | 472 | #1 | |
| 2 | 2.5 | 2.5 | 0.03 | 27 | | 472 | | #1 | |
| 3 | | | | 5 | | | 495 | #2 | |
| 4 | 21.5 | 23.4 | 0.27 | 19 | | 495 | | #2 | |
| 5 | | | | 7 | | | 530 | #3 | |
| 6 | 21.6 | 39.9 | 0.51 | 132 | Wait | 499 | | #3 | |
| 7 | | | | 8 | | | 533 | #4 | |

TABLE 3-continued

| Pass No. | Reduction of area (%) | Total reduction of area (%) | Total strain (—) | Pass interval (s) | Rolling wait | Entry temperature $T_{x\text{-}in}$ (° C.) | Exit temperature $T_{x\text{-}out}$ (° C.) | Caliber | Z value |
|---|---|---|---|---|---|---|---|---|---|
| 8 | 18.4 | 51.0 | 0.71 | 92 | Wait | 499 | | #4 | |
| 9 | | | | 5 | | | 538 | #5 | |
| 10 | 20.3 | 60.9 | 0.94 | 115 | Wait | 499 | | #5 | |
| 11 | | | | 5 | | | 534 | #6 | |
| 12 | 19.0 | 68.4 | 1.15 | 103 | Wait | 499 | | #6 | |
| 13 | 17.0 | 73.7 | 1.34 | 5 | | | 528 | #7 | |
| 14 | 18.6 | 78.6 | 1.54 | 72 | Wait | 499 | | #8 | |
| 15 | 15.6 | 81.9 | 1.71 | 10 | | | 543 | #9 | |
| 16 | 16.9 | 85.0 | 1.90 | 90 | Wait | 499 | | #10 | |
| 17 | 12.5 | 86.9 | 2.03 | 11 | | | 534 | #11 | |
| 18 | 6.8 | 87.8 | 2.10 | 88 | Wait | 496 | | #12 | |
| 19 | 13.8 | 89.4 | 2.25 | 9 | | | 517 | #13 | |
| 20 | | | | 49 | Wait | 498 | | #14 | |
| 21 | 14.8 | 91.0 | 2.41 | 7 | | | 501 | #14 | 14.2 |
| 22 | 38.0 | | | 123 | Wait | 450 | 514 | #15 | |
| 23 | 18.0 | 94.9 | 2.98 | 130 | Wait | 464 | 537 | #16 | 14.1 |

Embodiment 2

In succession to embodiment 1, further 2 passes were rolled until 17×17 mm. Caliber shapes are oval and square. Both are large in deformation, and the processing heat generation was measured by preliminary experiment. As a result, it was found that the material temperature rises by 80° C. by consecutive rolling of 2 passes. Accordingly, in passes 22 and 23, the entry temperatures $T_{22\text{-}in}$, $T_{23\text{-}in}$ were set at 450° C. Since the temperature of pass 21 was 501° C., by waiting until the material temperature dropped to 450° C., and rolling of pass 22 was started. The exit temperature of pass 23 was 514° C. At pass 23, waiting until 464° C., rolling was started, and the exit temperature was 537° C. (Table 3). The total rolling time was 1112 s, and the Z value was 14.1.

Figure 4:
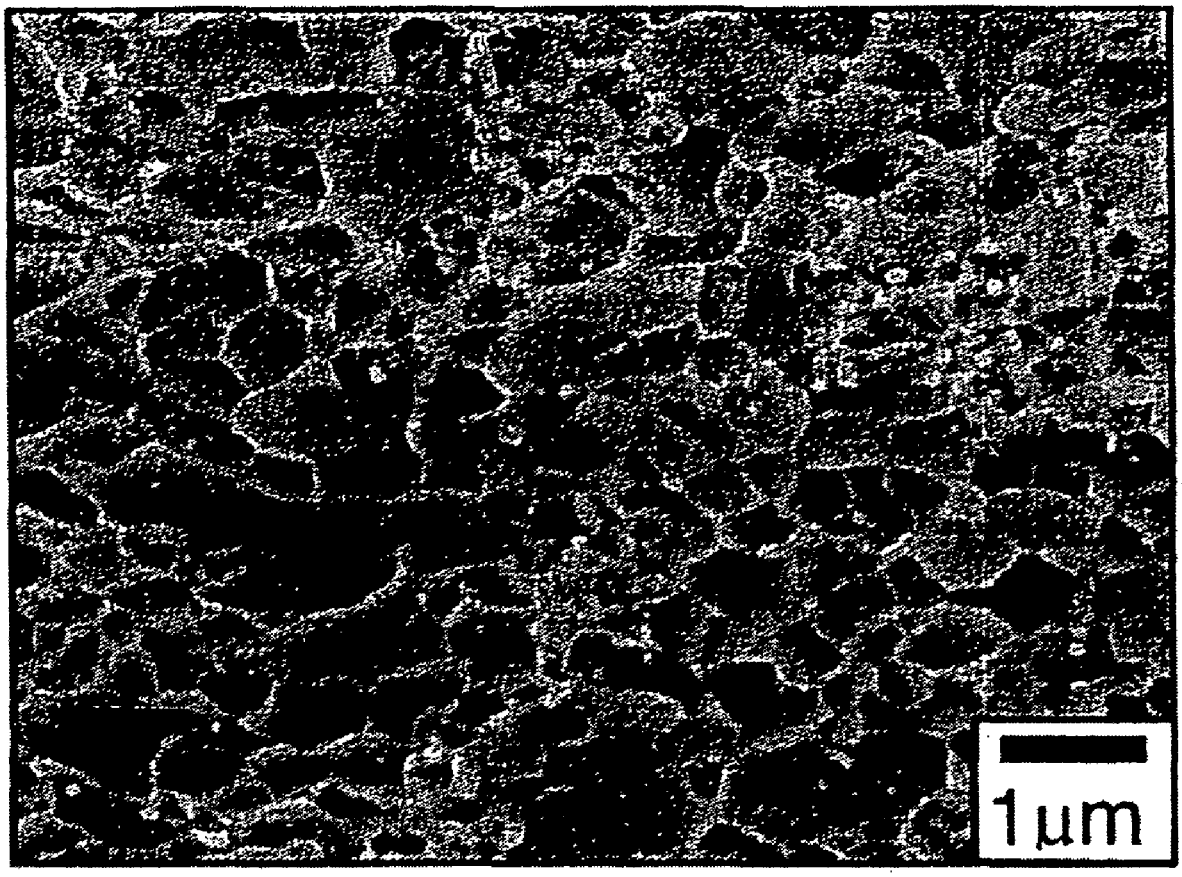
FIG. 4 is a texture SEM image in embodiment 2.

The obtained texture image is shown in FIG. 4. An ultrafine equiaxial ferrite+cementite texture was noted. The average ferrite grain size was 0.5 micron. Its mechanical properties are shown in Table 7, and a steel bar of excellent tensile strength of 830 MPa was obtained.

Embodiment 3

A steel material of 80×80×600 mm having the composition shown in Table 2b was heated to 900° C., and after once austenizing the texture, the material temperature was lowered to rolling set temperature T1 (550° C.) to transform the texture to ferrite+pearlite, and it was rolled in caliber in 20 passes at reduction of area of 91% (true strain 2.4) until the section was reduced to 24×24 mm. Supposing the total rolling time of 600 s, the set value of Z was 13.7. From FIG. 1, the ferrite grain size is estimated to be 0.6 micron.

Caliber shape of each pass, the draft and temperature changes before and after are given in Table 4. Right after rolling of even-number pass, the temperature (exit temperature) $T_{x\text{-}out}$ was measured, and when the exit temperature was lower than 550° C., rolling of next pass was started immediately, but when exceeding 550° C., rolling of next pass (odd-number pass) was started after waiting until the material temperature dropped below 570° C. The entry temperature of odd-number pass was not particularly controlled. As a result, the rolling was carried out in a range of entry temperature $T_{x\text{-}in}$ of 440 to 557° C. (average 551° C.) and exit temperature $T_{x\text{-}out}$ of 536 to 573° C. (average 551° C.). Therefore, although the maximum processing heat generation in rolling of two consecutive passes was 23° C., by setting the rolling waiting time, the rolling setting temperature of 550° C. did not exceed 600° C. throughout the whole rolling process. In other words, processing heat generation occurred in each pass, but did not exceed the set temperature by more than 50° C. By the total rolling time of 582 s and average exit temperature, the value of Z was calculated again, and Z=13.5 was obtained.

Figure 5:
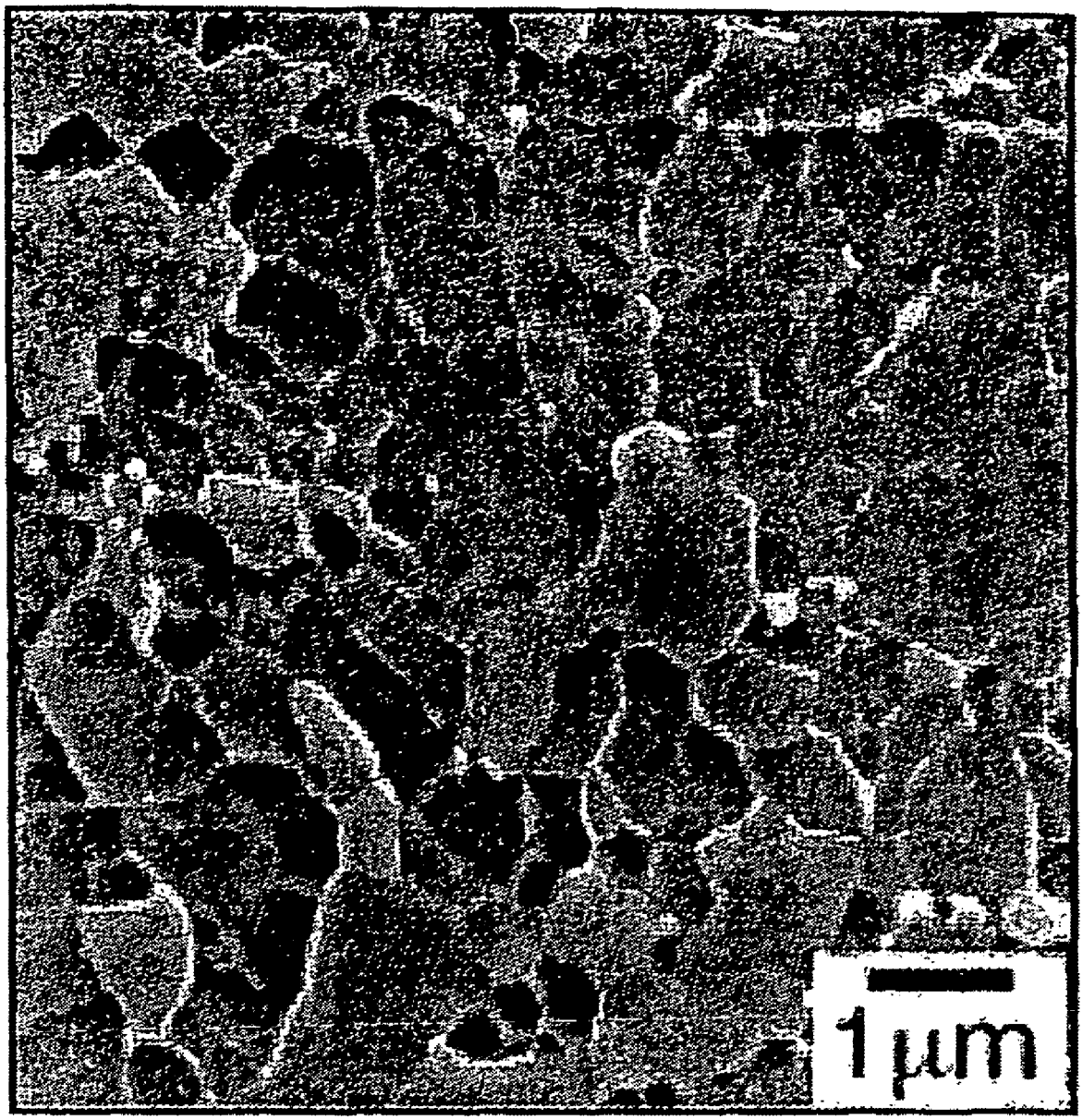
FIG. 5 is a texture SEM image in embodiment 3.

The obtained texture image is shown in FIG. 5. The composition is ultrafine equiaxial ferrite+cementite texture. The average ferrite grain size was 0.9 micron. Its mechanical properties are shown in Table 7, and a steel bar of excellent tensile strength of 702 MPa was obtained.

TABLE 4

| Pass No. | Reduction of area (%) | Total reduction of area (%) | Total strain (—) | Pass interval (s) | Rolling wait | Entry temperature $T_{x\text{-}in}$ (° C.) | Exit temperature $T_{x\text{-}out}$ (° C.) | Caliber | Z value |
|---|---|---|---|---|---|---|---|---|---|
| 1 | 2.5 | 2.5 | 0.03 | 0 | | 550 | | #1 | |
| 2 | | | | 6 | | | 548 | #2 | |
| 3 | 21.5 | 23.4 | 0.27 | 27 | | 545 | | #2 | |
| 4 | | | | 11 | | | 573 | #3 | |
| 5 | 21.6 | 39.9 | 0.51 | 66 | Wait | 550 | | #3 | |

TABLE 4-continued

| Pass No. | Reduction of area (%) | Total reduction of area (%) | Total strain (—) | Pass interval (s) | Rolling wait | Entry temperature $T_{x\text{-}in}$ (° C.) | Exit temperature $T_{x\text{-}out}$ (° C.) | Caliber | Z value |
|---|---|---|---|---|---|---|---|---|---|
| 6 | | | | 4 | | | 573 | #4 | |
| 7 | 18.4 | 51.0 | 0.71 | 68 | Wait | 557 | | #4 | |
| 8 | | | | 11 | | | 571 | #5 | |
| 9 | 20.3 | 60.9 | 0.94 | 61 | Wait | 556 | | #5 | |
| 10 | | | | 17 | | | 573 | #6 | |
| 11 | 19.0 | 68.4 | 1.15 | 59 | Wait | 557 | | #6 | |
| 12 | 17.0 | 73.7 | 1.34 | 18 | | | 561 | #7 | |
| 13 | 18.6 | 78.6 | 1.54 | 56 | Wait | 552 | | #8 | |
| 14 | 15.6 | 81.9 | 1.71 | 20 | | | 567 | #9 | |
| 15 | 16.9 | 85.0 | 1.90 | 25 | Wait | 553 | | #10 | |
| 16 | 12.5 | 86.9 | 2.03 | 15 | | | 567 | #11 | |
| 17 | 6.8 | 87.8 | 2.10 | 57 | Wait | 550 | | #12 | |
| 18 | 13.8 | 89.4 | 2.25 | 25 | | | 545 | #13 | |
| 19 | | | | 22 | | 540 | | #14 | |
| 20 | 14.8 | 91.0 | 2.41 | 14 | | | 536 | #14 | 13.5 |
| 21 | 38.0 | | | 65 | Wait | 500 | 568 | #15 | |
| 22 | 18.0 | 94.9 | 2.98 | 15 | | 550 | 599 | #16 | 13.5 |

Embodiment 4

In succession to embodiment 3, further 2 passes were rolled until 17×17 mm. Caliber shapes are oval and square. Both are large in deformation, and the processing heat generation was measured by preliminary experiment. As a result, it was found that the material temperature rises by 80° C. by consecutive rolling of 2 passes. Accordingly, in passes 21 and 22, the entry temperatures $T_{21\text{-}in}$, $T_{22\text{-}in}$ were set at 500° C. Since the temperature of pass 20 was 536° C., by waiting until the material temperature dropped to 500° C., and rolling of pass 21 was started. The exit temperature of pass 21 was 568° C. At pass 22, waiting until 550° C., rolling was started, and the exit temperature was 599° C. The total rolling time was 662 s, the average exit temperature was 565° C., and Z was 13.6.

Figure 6:
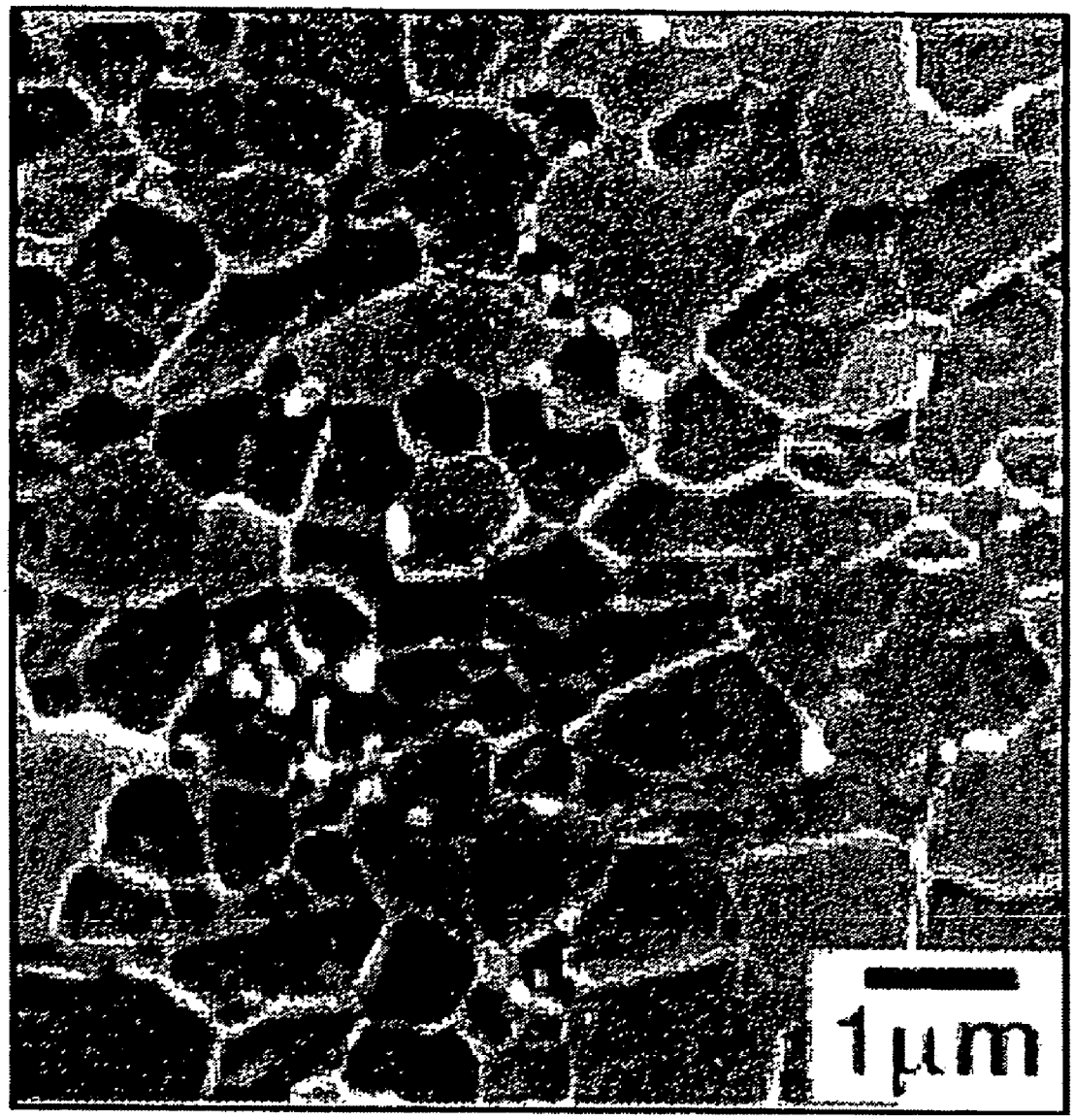
FIG. 6 is a texture SEM image in embodiment 4.

The obtained texture image is shown in FIG. 6. An ultrafine equiaxial ferrite+cementite texture was noted. The average ferrite grain size was 1.1 micron. Its mechanical properties are shown in Table 7, and a steel bar of excellent tensile strength of 712 MPa was obtained.

Embodiment 5

A steel material of 80×80×600 mm having the composition shown in Table 2c was heated to 600° C., and rolled in caliber at rolling set temperature T1 (600° C.), in 21 passes at reduction of area of 95% (true strain 3.0) until the section was reduced to 17×17 mm. Supposing the total rolling time of 300 s, the set value of Z was 13.1. From FIG. 1, the ferrite grain size is estimated to be 0.8 micron.

Right after rolling of even-number pass, the temperature (exit temperature) $T_{x\text{-}out}$ was measured, and when the exit temperature was lower than 600° C., rolling of next pass was started immediately, but when exceeding 600° C., rolling of next pass (odd-number pass) was started after waiting until the material temperature dropped below 600° C. The entry temperature of odd-number pass was not particularly controlled. As a result, the rolling was carried out in a range of entry temperature $T_{x\text{-}in}$ of 580 to 619° C. (average 590° C.) and exit temperature $T_{x\text{-}out}$ of 610 to 648° C. (average 630° C.). Therefore, although the maximum processing heat generation in rolling of two consecutive passes was 40° C., by setting the rolling waiting time, the rolling setting temperature of 600° C. did not exceed 650° C. throughout the whole rolling process. In other words, processing heat generation occurred in each pass, but did not exceed the set temperature by more than 50° C. By the total rolling time of 800 s and average exit temperature, the value of Z was calculated again, and Z=12.2 was obtained. The obtained texture image is ultrafine equiaxial ferrite+cementite texture. The average ferrite grain size was 1.4 micron. Its mechanical properties are shown in Table 7, and a steel bar of excellent tensile strength of 640 MPa was obtained.

Embodiment 6

A steel material of 80×80×600 mm having the composition shown in Table 2a was heated to 500° C., and rolled in caliber at rolling set temperature T1 (475° C.), in 21 passes at reduction of area of 95% (true strain 3.0) until the section was reduced to 17×17 mm. Right after rolling of even-number pass, the temperature (exit temperature) $T_{x\text{-}out}$ was measured, and when the exit temperature was lower than 475° C., rolling of next pass was started immediately, but otherwise, rolling of next pass (odd-number pass) was started after waiting until the material temperature dropped below 475° C. so as not to exceed 500° C. (Table 5). The entry temperature of odd-number pass was not particularly controlled. As a result, the rolling was carried out in a range of entry temperature $T_{x\text{-}in}$ of 440 to 485° C. (average 465° C.) and exit temperature $T_{x\text{-}out}$ of 472 to 499° C. (average 496° C.). Therefore, although processing heat generation occurs in each pass, but does not exceed the set temperature by more than 50° C. By the total rolling time of 1128 s and average exit temperature, the value of Z was calculated again, and Z=14.7 was obtained. The obtained texture image is ultrafine equiaxial ferrite+cementite texture. The average ferrite grain size was 0.45 micron. The tensile strength was 950 MPa.

TABLE 5

| Pass No. | Reduction of area (%) | Total reduction of area (%) | Total strain (—) | Pass interval (s) | Rolling wait | Entry temperature $T_{x\text{-}in}$ (° C.) | Exit temperature $T_{x\text{-}out}$ (° C.) | Caliber | Z value |
|---|---|---|---|---|---|---|---|---|---|
| 1 | | | | 0 | | 455 | 472 | #1 | |
| 2 | 2.5 | 2.5 | 0.03 | 27 | | 472 | | #1 | |
| 3 | | | | 5 | | | 495 | #2 | |
| 4 | 21.5 | 23.4 | 0.27 | 50 | Wait | 475 | | #2 | |
| 5 | | | | 7 | | | 499 | #3 | |
| 6 | 21.6 | 39.9 | 0.51 | 130 | Wait | 475 | | #3 | |
| 7 | | | | 8 | | | 499 | #4 | |
| 8 | 18.4 | 51.0 | 0.71 | 90 | Wait | 470 | | #4 | |
| 9 | | | | 5 | | | 498 | #5 | |
| 10 | 20.3 | 60.9 | 0.94 | 116 | Wait | 475 | | #5 | |
| 11 | | | | 5 | | | 498 | #6 | |
| 12 | 19.0 | 68.4 | 1.15 | 100 | Wait | 475 | | #6 | |
| 13 | 17.0 | 73.7 | 1.34 | 5 | | | 499 | #7 | |
| 14 | 18.6 | 78.6 | 1.54 | 70 | Wait | 475 | | #8 | |
| 15 | 15.6 | 81.9 | 1.71 | 10 | | | 497 | #9 | |
| 16 | 16.9 | 85.0 | 1.90 | 91 | Wait | 470 | | #10 | |
| 17 | 12.5 | 86.9 | 2.03 | 11 | | | 498 | #11 | |
| 18 | 6.8 | 87.8 | 2.10 | 85 | Wait | 470 | | #12 | |
| 19 | 13.8 | 89.4 | 2.25 | 9 | | | 495 | #13 | |
| 20 | | | | 41 | Wait | 480 | | #14 | |
| 21 | 14.8 | 91.0 | 2.41 | 7 | | | 499 | #14 | |
| 22 | 38.0 | | | 125 | Wait | 440 | 498 | #15 | |
| 23 | 18.0 | 94.9 | 2.98 | 131 | Wait | 440 | 495 | #16 | 14.7 |

Comparative Example 1

A steel material of 80×80×600 mm having the composition shown in Table 2 was heated to 500° C., and rolled in caliber at rolling set temperature T1 (550° C.), in 21 passes at reduction of area of 91% (true strain 2.4) until the section was reduced to 24×24 mm. The pass interval was 15 s.

Figure 7:
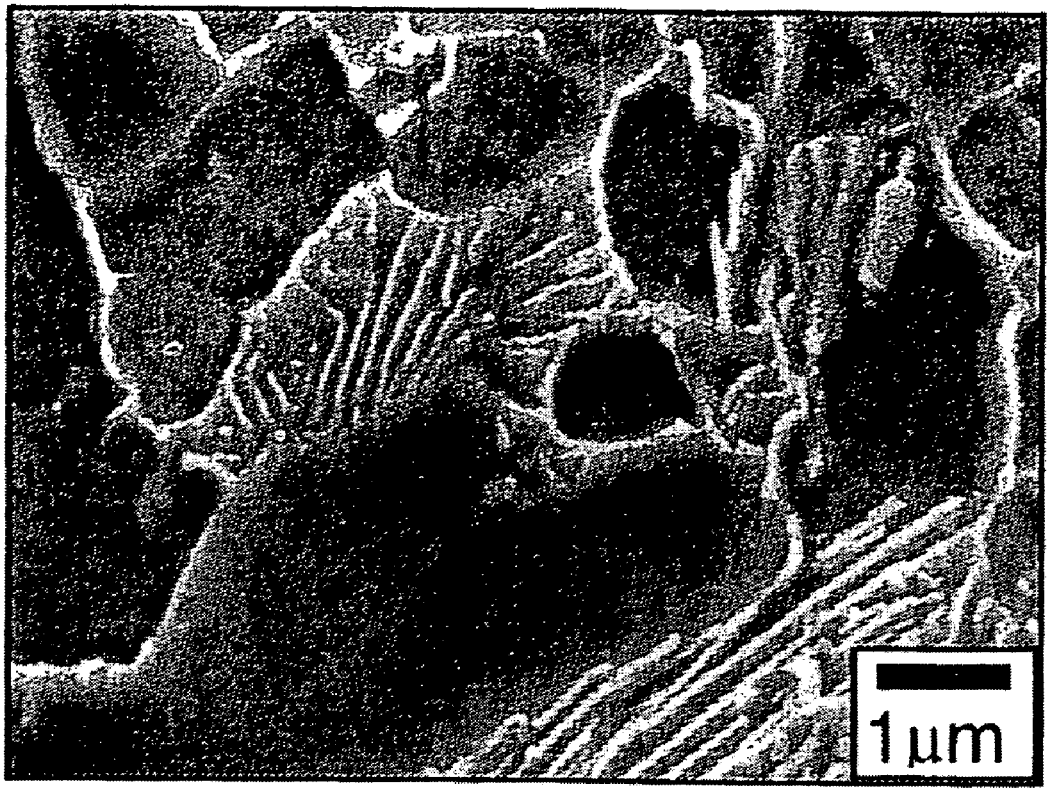
FIG. 7 is a texture SEM image in comparative example.

Without any particular temperature control, results of rolling are shown in Table 6. The processing heat generation occurring in each pass was accumulated, and the final material temperature was more than 800° C. At the final exit temperature, the value of Z was calculated again, and Z was 10.1. At the average temperature, it was 11.9. The obtained texture image is shown in FIG. 7. Although it was a ferrite+cementite texture, the average ferrite grain size was 4 microns. The ferrite grain size was larger than expected from the average temperature.

TABLE 6

| Pass No. | Reduction of area (%) | Total reduction of area (%) | Total strain (—) | Pass interval (s) | Rolling wait | Entry temperature $T_{x\text{-}in}$ (° C.) | Exit temperature $T_{x\text{-}out}$ (° C.) | Caliber | Z value |
|---|---|---|---|---|---|---|---|---|---|
| 1 | | | | 0 | | 550 | 552 | #1 | |
| 2 | 2.5 | 2.5 | 0.03 | 10 | | 549 | | #1 | |
| 3 | | | | 10 | | | 574 | #2 | |
| 4 | 21.5 | 23.4 | 0.27 | 10 | | 571 | | #2 | |
| 5 | | | | 10 | | | 594 | #3 | |
| 6 | 21.6 | 39.9 | 0.51 | 10 | | 591 | | #3 | |
| 7 | | | | 10 | | | 619 | #4 | |
| 8 | 18.4 | 51.0 | 0.71 | 10 | | 616 | | #4 | |
| 9 | | | | 10 | | | 639 | #5 | |
| 10 | 20.3 | 60.9 | 0.94 | 10 | | 636 | | #5 | |
| 11 | | | | 10 | | | 664 | #6 | |
| 12 | 19.0 | 68.4 | 1.15 | 10 | | 661 | | #6 | |
| 13 | 17.0 | 73.7 | 1.34 | 10 | | | 684 | #7 | |
| 14 | 18.6 | 78.6 | 1.54 | 10 | | 681 | | #8 | |
| 15 | 15.6 | 81.9 | 1.71 | 10 | | | 709 | #9 | |
| 16 | 16.9 | 85.0 | 1.90 | 10 | | 706 | | #10 | |
| 17 | 12.5 | 86.9 | 2.03 | 10 | | | 729 | #11 | |
| 18 | 6.8 | 87.8 | 2.10 | 10 | | 726 | | #12 | |
| 19 | 13.8 | 89.4 | 2.25 | 10 | | | 754 | #13 | |
| 20 | | | | 10 | | 751 | | #14 | |
| 21 | 14.8 | 91.0 | 2.41 | 10 | | | 774 | #14 | |
| 22 | 38.0 | | | 10 | | 771 | 814 | #15 | |
| 23 | 18.0 | 94.9 | 2.98 | 10 | | 809 | 839 | #16 | 11.9 |

TABLE 7

| | Ferrite grain size (μm) | Yield strength (MPa) | Tensile strength (MPa) |
|---|---|---|---|
| Embodiment | | | |
| 1 | 0.6 | 775 | 788 |
| 2 | 0.5 | 825 | 830 |
| 3 | 0.9 | 683 | 702 |
| 4 | 1.1 | 705 | 712 |
| 5 | 1.4 | 600 | 640 |
| 6 | 0.45 | 940 | 950 |
| Comparative example | | | |
| 1 | 3.1 | 480 | 560 |

INDUSTRIAL APPLICABILITY

As described specifically herein, the new method of controlling the parameter Z by the present invention can be applied to a continuous rolling process, and the invention provides a new control rolling method, in consideration of processing heat generation, as a method of stably manufacturing ultrafine crystal steel of 3 microns to 1 micron or less, without any limitation in pass interval or strain speed.

The invention claimed is:

1. A warm control rolling method, for manufacturing steel mainly composed of fine ferrite particle texture with average ferrite grain size controlled by a desired value of 3 μm or less, which comprises, rolling the steel, in continuous multipass rolling at a rolling temperature range of 350° C. to 800° C., in a condition where the rolling condition parameter expressed in formula (1)

$$Z = \log\left[\frac{\varepsilon}{t}\exp\left(\frac{Q}{8.31(T+273)}\right)\right] \quad (1)$$

ϵ: strain t: duration from start till end of rolling (s)

T: rolling temperature (° C., or average of rolling temperature of each pass in the case of multipass rolling)

Q: 254,000 if mother phase of texture just before rolling is ferrite, bainite, martensite, or pearlite; 300,000 if mother phase is austenite, is 11 or more (in the case the texture just before rolling is ferrite, bainite, martensite, or pearlite, that is, Fe crystal structure is bcc) or 20 or more (in the case the texture just before rolling is austenite, that is, Fe crystal structure is fcc), and wherein at least one pass interval is longer than 20 seconds, so that the material temperature upon start of rolling of each rolling pass does not exceed the maximum temperature of 800° C., and the material temperature during rolling and right after final rolling (within 1 second) is not 350° C. or lower, and so that, in each rolling pass, temperature $T_{x\text{-}out}$ right after rolling (within 1 second) is not higher than temperature that is higher than rolling entry temperature $T_{x\text{-}in}$ by 100° C. and the material temperature right after rolling (within 1 second) is not lower than temperature that is lower than the temperature right before rolling by 100° C.

2. The warm control rolling method of claim 1, wherein the temperature $T_{x\text{-}out}$ right after rolling in each rolling pass is not higher than temperature that is higher than the rolling entry temperature $T_{x\text{-}in}$ by 50° C.

3. The warm control rolling method of claim 2, wherein the rolling temperature range is 400° C. to 500° C.

4. The warm control rolling method of claim 2, wherein Z is 12 or more and, the method is for manufacturing steel mainly composed of fine ferrite particle texture with an average ferrite grain size controlled by a desired value of 1 μm or less.

5. The warm control rolling method of claim 1, comprising rolling two or more passes consecutively in rolling temperature range of 350° C. to 800° C., wherein the material temperature right after two passes is not higher than temperature that is higher than the material temperature upon start of rolling by 100° C., and not lower than temperature that is lower than the material temperature upon start of rolling by 100° C.

6. The warm control rolling method of claim 5, wherein the material temperature right after two passes is not higher than temperature that is higher than the material temperature upon start of rolling by 50° C.

7. The warm control rolling method of claim 6, wherein the rolling temperature range is 400° C. to 500° C.

8. The warm control rolling method of claim 6, wherein Z is 12 or more and, the method is for manufacturing steel mainly composed of fine ferrite particle texture with an average ferrite grain size controlled by a desired value of 1 μm or less.

9. The warm control rolling method of claim 5, wherein the rolling temperature range is 400° C. to 500° C.

10. The warm control rolling method of claim 5, wherein Z is 12 or more and, the method is for manufacturing steel mainly composed of fine ferrite particle texture with an average ferrite grain size controlled by a desired value of 1 μm or less.

11. The warm control rolling method of claim 1, wherein the rolling temperature range is 400° C. to 500° C.

12. The warm control rolling method of claim 11, wherein Z is 12 or more and, the method is for manufacturing steel mainly composed of fine ferrite particle texture with an average ferrite grain size controlled by a desired value of 1 μm or less.

13. The warm control rolling method of claim 1, wherein Z is 12 or more and, and the method is for manufacturing steel mainly composed of fine ferrite particle texture with an average ferrite grain size controlled by a desired value of 1 μm or less.

14. The warm control rolling method of claim 1, further comprising, in starting rolling in consecutive multipass rolling, waiting until the rolling entry temperature $T_{x+1\text{-}in}$ of X+1-th pass becomes $Ts+20 \geqq T_{x+1\text{-}in}$ when the rolling temperature $T_{x\text{-}out}$ right after X-th pass is higher than chosen rolling temperature Ts.

15. The warm control rolling method of claim 1, further comprising measuring the processing heat generation $T_{xH}$ at X-th pass in multipass rolling beforehand, and defining the rolling entry temperature $T_{x\text{-}in}$ in the relation of $T_{xs} \geqq T_{x\text{-}in} \geqq T_{xs} - T_{xH}$, where $T_{xs}$ is a chosen rolling temperature.

16. The warm control rolling method of claim 1, wherein a total reduction area in continuous rolling is 50% or more.

17. The warm control rolling method of claim 1, wherein a plastic strain, or a strain converted into true strain from a reduction of area is 1.5 or more.

18. The warm control rolling method of claim 1, further comprising introducing the strain by multidirectional processing.

19. The warm control rolling method of claim 1, further comprising controlling the temperature range before and after rolling by setting a rolling speed and a draft of each pass.

20. The warm control rolling method of claim 1, wherein the continuous rolling further comprises a step of reheating in the midst of rolling for compensating for temperature drop of material, and a step of cooling in the midst of rolling for suppressing temperature rise of material.

* * * * *